US005126009A

United States Patent [19]

Berry et al.

[11] Patent Number: 5,126,009

[45] Date of Patent: Jun. 30, 1992

[54] PROCESS FOR DECREASING THE CHARGE OF CHEMICAL REQUIRED IN A CHLORINE BLEACHING EXTRACTION STAGE

[75] Inventors: Richard M. Berry, Ile Perrot; Bruce I. Fleming, Senneville, both of Canada

[73] Assignee: Pulp and Paper Research Institute of Canada, Pointe Claire, Canada

[21] Appl. No.: 543,924

[22] Filed: Jun. 26, 1990

Related U.S. Application Data

[63] Continuation-in-part of Ser. No. 49,249, May 13, 1987, abandoned.

[30] Foreign Application Priority Data

May 30, 1986 [CA] Canada ..... 510446

[51] Int. Cl.[5] ..... D21C 9/02; D21C 9/12

[52] U.S. Cl. ..... 162/29; 162/60; 162/89

[58] Field of Search ..... 162/60, 29, 88, 89, 162/57

[56] References Cited

U.S. PATENT DOCUMENTS

| | | | |
|---|---|---|---|
| Re. 23,868 | 9/1954 | Limerick | 162/60 |
| 1,683,262 | 9/1928 | Richter et al. | 162/60 |
| 2,711,359 | 6/1955 | Johansen | 162/60 |
| 2,745,712 | 5/1956 | Burling et al. | 162/60 |
| 4,070,234 | 1/1978 | Anderson et al. | 162/60 |
| 4,104,114 | 8/1978 | Rowlandson et al. | 162/60 |
| 4,529,479 | 7/1985 | Tuomi | 162/60 |
| 4,543,155 | 9/1985 | Stawicki | 162/57 |

OTHER PUBLICATIONS

Berry et al., "Papricycle", 1988 Pulping Conf. New Orleans, Oct. 30–Nov. 2, 1988.

*Primary Examiner*—Steve Alvo

*Attorney, Agent, or Firm*—Millen, White & Zelano

[57] ABSTRACT

Disclosed is an improved chlorinated pulp bleaching process and apparatus which reduces caustic requirements significantly, wherein the washed chlorinated pulp, after first separating therefrom the effluent from the chlorination stage washing step, is treated with recycled alkaline extraction stage effluent in an additional washing step between the chlorination stage washing step and the extraction stage washing step; and wherein the effluent from the additional washing step is separated from the twice-washed pulp and, optionally wherein that effluent is recycled as shower water for the chlorination stage washing step, before the twice washed pulp is mixed with the caustic in the extraction stage.

8 Claims, 4 Drawing Sheets

PROCESS FOR DECREASING THE CHARGE OF CHEMICAL REQUIRED IN A CHLORINE BLEACHING EXTRACTION STAGE

This is a continuation-in-part of application Ser. No. 07/049,249, filed May 13, 1987, now abandoned.

BACKGROUND OF THE INVENTION

1. Field of the Invention

The present invention relates to an improvement in the chlorine bleaching process and apparatus and in particular, relates to an improved method and apparatus for decreasing the charge of alkali required in the bleaching extraction stage thereof.

2. Description of the Prior Art

The recycling of some of the extraction effluent during chlorination pulp bleaching is a common practice, either to conserve heat values or to displace the acidic chlorination liquor. The recycled extraction stage liquor is added to the chlorinated pulp as it leaves the chlorination stage washer via the washer showers and this recycled liquor is carried with the pulp back into the extraction stage (Histed, J. A. and Nelson, Jr., G. G. in "The Bleaching of Pulp" , R. P. Singh, Ed., 3rd Edition, TAPPI Press, Atlanta, 1979, p. 393; Histed, J. A. and Nicolle, F. M. A., Pulp Paper Mag. Can. 74 (5) T171 (1974); Wartiovaara, I. Paperi ja Puu 62 (5) 319 (1980); and Wartiovaara, I., Pulp Paper Can. 81 (7) T167 (1980)).

It is also known in the prior art (Burkart, L. F., Paper Trade J. 156 (2) 33 (1972) and Azad, A. M. and Burkart, L. F., Tappi 59 (4) (1976)) to use recycled effluent fortified with sodium hydroxide as the extracting liquor for the first extraction stage. This is found to decrease the amount of sodium hydroxide required in the extraction stage by about 16%.

Limerick (Re 23,868) discloses (col. 3, lines 42–51) a process in which a portion of the alkaline effluent from an extraction stage washer which follows an extraction stage "steeping tower" (in which the chlorine values of a chlorinated pulp are extracted from the pulp with caustic previously mixed therewith) is used to dilute the stock going to that washer by recycling to the second of a pair of post-chlorination pre-caustic extraction washers, where some is used as shower water and some is used to dilute the pulp leaving that washer. However, this method of recycling the alkaline extraction stage effluent does not result in any significant savings in the caustic required in the extraction stage because the acid values which react with the recycled effluent generate like amounts of caustic-consuming sodium bicarbonate and $CO_2$, which are carried with the pulp and react with the alkali added to the pulp directly after the post-chlorination, pre-caustic extraction washers.

SUMMARY OF THE INVENTION

Objects of the Invention

It is an object of the present invention to provide an improved process and apparatus for decreasing the amount of alkali required in the extraction stage of a chlorinated pulp bleaching process.

Summary of the Invention

In a process aspect, this invention relates to an improved pulp bleaching process wherein a chlorinated pulp is sequentially washed in a chlorination stage washing step, the washed pulp is separated from the effluent, the separated washed pulp is mixed with an alkaline extracting solution and subjected to an alkaline extraction (step) stage, the extraction stage pulp is washed in an alkaline extraction stage washing step, and the washed, extracted pulp is then separated from the thus-produced alkaline effluent, which comprises the steps of:

(i) mixing the separated washed chlorinated pulp, at a point between the chlorination washing step and the step of mixing the pulp with an alkaline extracting solution, with the alkaline effluent from the extraction stage, e.g., for at least about 30 seconds at a temperature of about 25°0 C. or higher; and (ii) separating the thus-obtained effluent from the thus-treated pulp prior to mixing the latter with the alkaline extraction solution in the extraction stage, whereby the amount of alkali required in the alkaline extraction stage is decreased.

In an apparatus aspect, this invention relates to an improved pulp bleaching apparatus for conducting a pulp chlorination bleaching process wherein a chlorinated pulp is sequentially washed in a chlorination stage washing step, the washed pulp is separated from the effluent, the separated washed pulp is mixed with an alkaline extracting solution and subjected to an alkaline extraction (step) stage, the extraction stage pulp is washed in an alkaline extraction stage washing step, and the washed extractions stage pulp is then separated from the thus-produced alkaline effluent, which apparatus comprises:

(i) means for mixing the separated washed chlorinated pulp, at a point between the chlorination washing step and the step of mixing the pulp with the alkaline extraction solution, with the separated alkaline effluent from the extraction stage, e.g., for at least about 30 seconds at a temperature of about 25° C. or higher; and (ii) means for separating the thus-obtained effluent from the thus-treated pulp prior to mixing the latter with the alkaline extraction solution, thereby decreasing the amount of alkali required in the alkaline extraction stage.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DISCLOSURE

Figure 1:
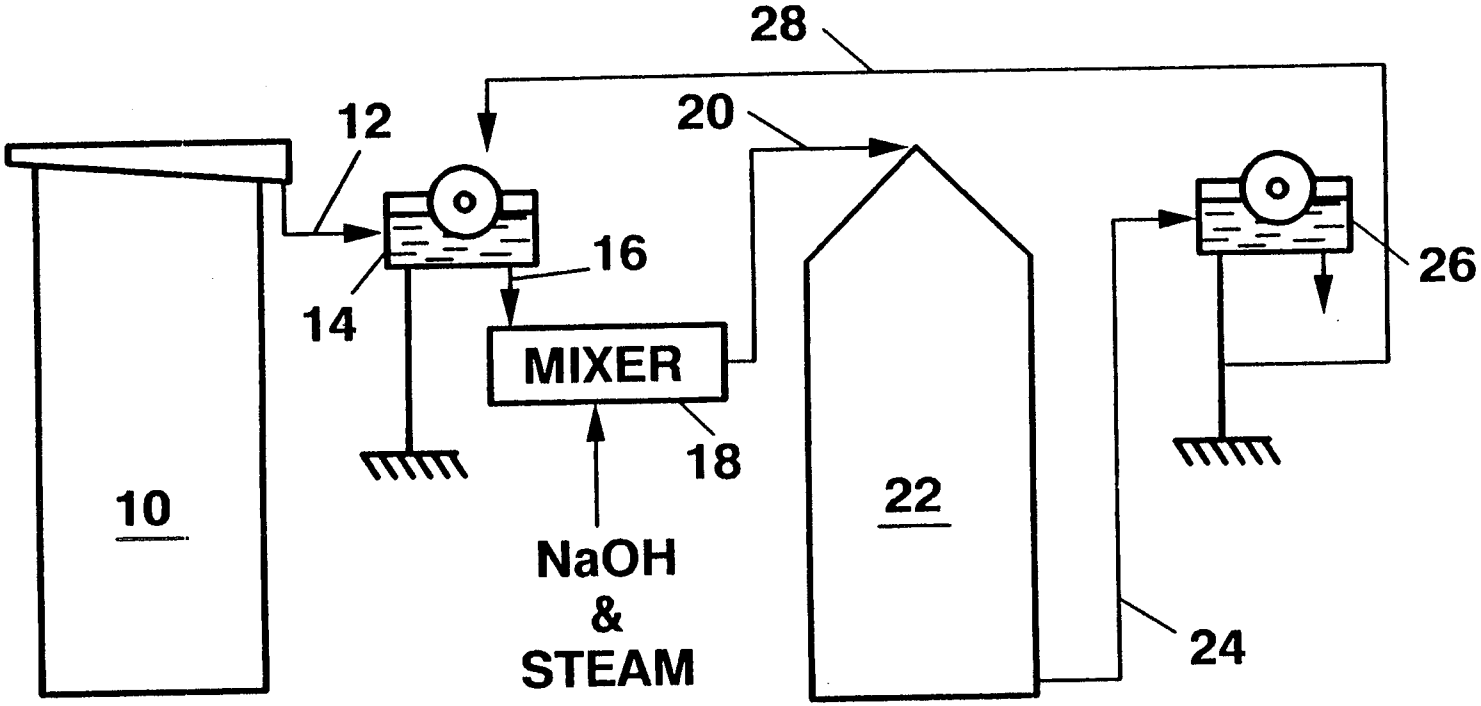
PRIOR ART Figure 1
FIG. 1 is a simplified flow diagram for a prior art recycling system in a conventional bleach plant having a chlorination stage followed by an extraction stage.

The caustic recycle process of this invention, known industrially as "Papricycle" is a process in which washed, chlorinated pulp is treated with recycled $E_1$-stage filtrate and is then washed again before being mixed with caustic; a procedure which enables the $E_1$-stage sodium hydroxide charge to be decreased. The process is now being used successfully in several mills, e.g., by Weyerhaeuser Canada in the 'A' bleach plant of the Kamloops mill to provide a savings of 35% in caustic usage in the $E_1$-stage.

Electrolytic cells produce chlorine and caustic in a fixed ratio. If the market demand for these chemicals does not closely correspond to the electrochemical ratio, there is an immediate upward pressure on the cost of whichever chemical is in short supply. The demand for caustic is presently outstripping the demand for chlorine and the situation is not expected to improve. Therefore, processes which decrease the demand for caustic should lower costs not only by saving caustic but also by helping to maintain the balance in the chlorine to caustic ratio.

One method of lessening the demand for caustic is to ensure that the alkaline streams within the mill are used efficiently. The following describes the Papricycle process, which makes better use of one of these alkaline streams and how one mill has applied it.

Extraction stage filtrate (effluent) is an alkaline stream which has the potential for more efficient use. This is because about 25% of the sodium hydroxide consumed in the $E_1$-stage is converted into sodium carbonate and sodium carbonate has been shown in published reports to have a positive reaction on chlorinated pulp by decreasing the CE kappa number through a partial extraction of the pulp. If extraction stage filtrate is added to well-washed chlorinated pulp, several reactions can occur. First, any residual sodium hydroxide will be consumed by forming sodium chloride, sodium carbonate and organic acid salts (Equation 1). Second, any sodium carbonate (including that formed from the residual sodium hydroxide), will be consumed by forming sodium chloride, sodium bicarbonate and organic acid salts (Equation 2). Finally, if there is a sufficient excess of acidic chlorinated pulp, the sodium bicarbonate formed from the reaction of sodium carbonate will react further giving carbon dioxide and again sodium chloride and organic acid salts (Equation 3). Thus, each of the alkali sources can be used to give a useful reaction.

$$\text{Chlorinated Pulp} + NaOH \rightarrow Na_2CO_3 + NaCl + \text{Na-Organics} \quad (1)$$

$$\text{Chlorinated Pulp} + Na_2CO_3 \rightarrow NaHCO_3 + NaCl + \text{Na-Organics} \quad (2)$$

$$\text{Chlorinated Pulp} + NaHCO_3 \rightarrow CO_2 + NaCl + \text{Na-Organics} \quad (3)$$

$$NaOH + NaHCO_3 \rightarrow Na_2CO_3 + H_2O \quad (4)$$

$$NaOH + CO_2 \rightarrow NaHCO_3 (5)$$

In a normal recycle process (e.g., direct counter-current) much of the recycled alkalinity ends up as $NaHCO_3$ or dissolved $CO_2$ (Equations 2 and 3) which is carried forward in the pulp to the E-stage. Unfortunately, $NaHCO_3$ and $CO_2$ are acidic to caustic soda and consume it as shown in Equations 4 and 5. The protons stripped from the chlorinated pulp are stored as $NaHCO_3$ in the liquor and are carried back to the E-stage where they consume caustic. However, the situation changes if the pulp is washed after the addition of the recycled effluent.

Figure 3:
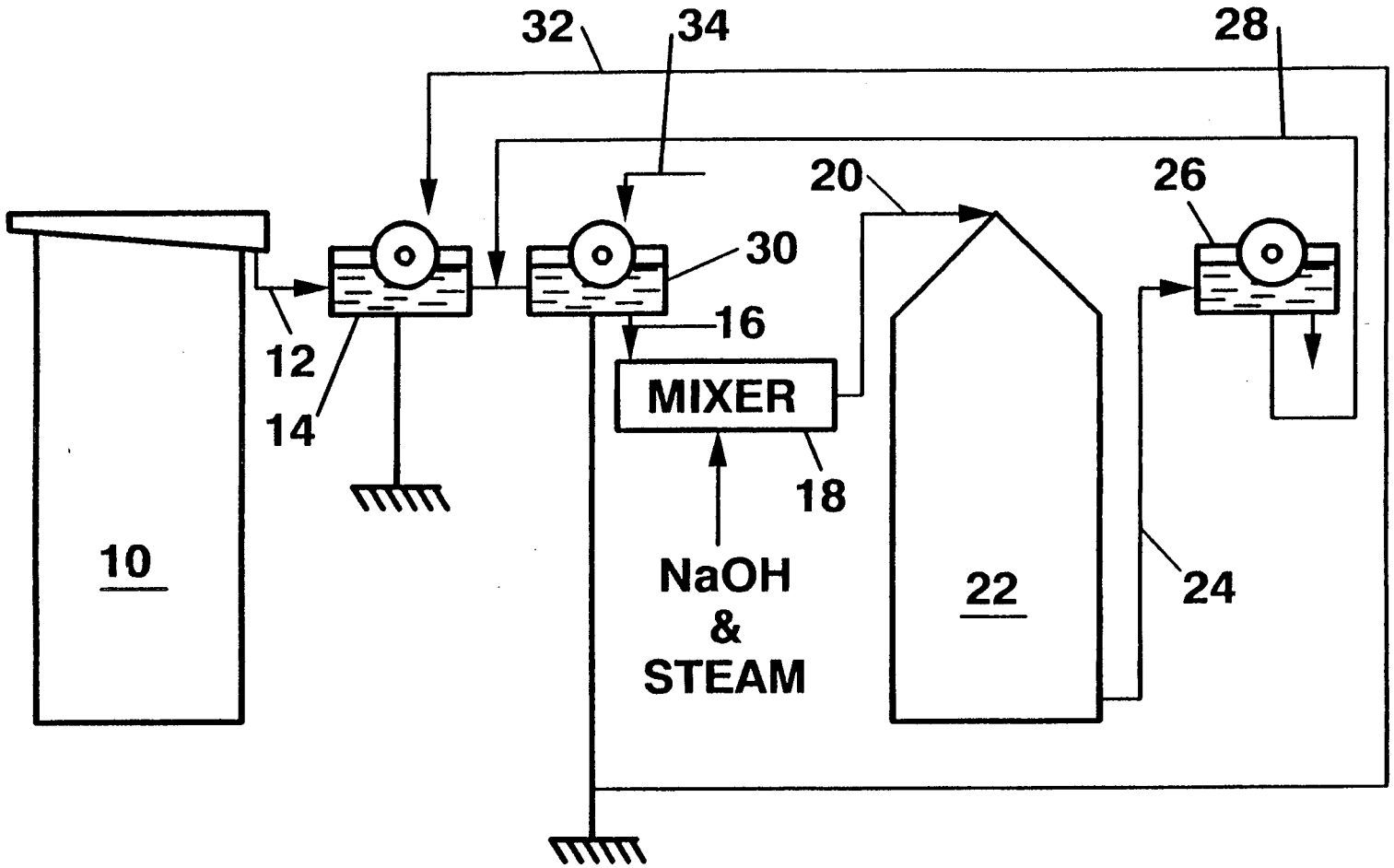
FIG. 3 is a flow diagram similar to FIG. 1 illustrating a version of the improved system of the present invention.

As shown in FIG. 3, some or preferably all, of the alkaline effluent from the extraction stage washer 26 is recycled in the process of the invention. It can be recycled by being mixed with the washed chlorination stage pulp before it reaches the second washer 30, as shown in FIG. 3, or before the pulp is separated from the effluent in the second washer 30. The time of contact of the recycled effluent with the washed chlorination stage pulp in washer 30 is not critical, as the reaction of the alkali in the effluent with the pulp is very rapid, e.g., within about 30 seconds or less at a temperature of 25° C. or higher.

Figure 4:
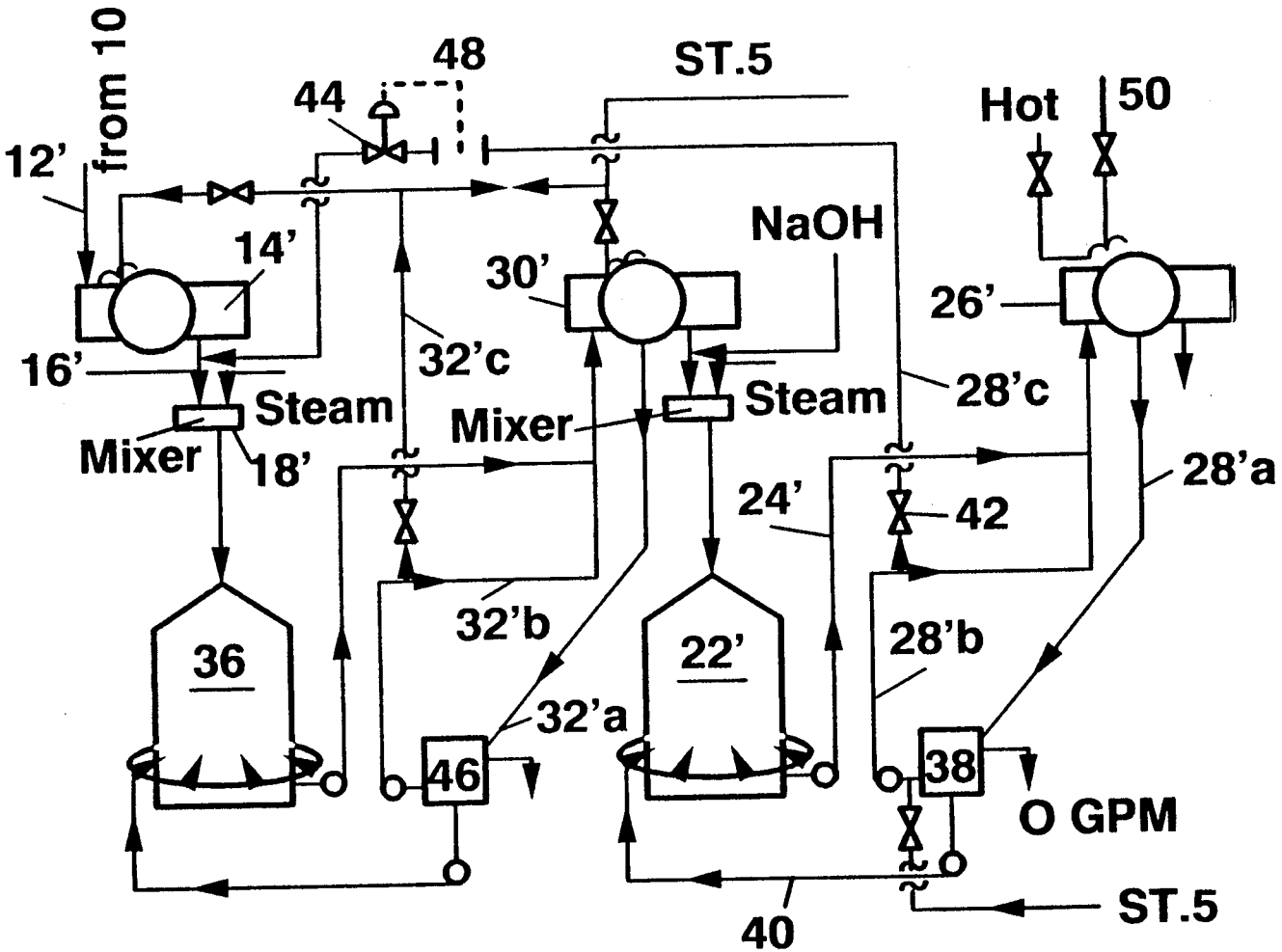
FIG. 4 is a flow diagram of the part of a mill bleach plant adapted to practice the process of this invention.

It is critical to the savings in caustic realized in the process of this invention that the pulp is treated with recycled alkaline effluent from the extraction stage and that the resulting effluent is thereafter separated from the thus-treated pulp before it is mixed with the alkali used in the extraction stage. Although the separation is most conveniently conducted in a second washer, as shown in FIGS. 3 and 4, as would be apparent, it can also be conducted by pressing, e.g., to a 20% consistency. Because some of the treatment liquid, which is acidic to the alkali used in the extraction stage, remains with the treated pulp, the savings in alkali required in the extraction stage is somewhat less than when the effluent is separated in a second washer.

In the preferred embodiment shown in FIGS. 3 and 4, some or all of the effluent separated after the recycled alkaline effluent treatment stage which although acidic to the alkali used in the extraction stage is alkaline to the chlorination stage pulp, is recycled to and used as some or all of the shower water in the chlorination stage washer.

The process of this invention, as it is presently practiced commercially, is described in preprints of papers given by Berry, R. M., et al. at the 1987 Canadian Pulp & Paper Spring Conf; Whistler, B. C.; ibid., 74th Annual Meeting Jan. 28 and 29, 1988, Montreal, Quebec; ibid. 1988 Spring Conf., May 19-21, 1988, Jasper, Alberta; ibid. 1988, Int. Pulp Bleaching conf., June 5-9, 1988, Orlando, Fla. (TAPPI Press, pp. 271-276); ibid., 1988 Pulping Conf. Oct. 30-Nov. 2, 1988 (TAPPI Notes, TAPPI, Book 3, pp. 747-752).

Detailed Description of the Drawings

The pulp chlorination methods described herein include the various modifications of the chlorination stage in which chlorine dioxide replaces some or all of the chlorine. Chlorine and chlorine dioxide are examples of oxidizing chemicals that can be used prior to the alkaline extraction stage. Any extraction stage preceded by an oxidizing step can be improved in accordance with this invention.

In greater detail, a conventional chlorination bleaching system is shown in FIG. 1 which has a recycling step which includes a chlorination tower 10, piping 12 leading to a chlorination washer 14, piping 16 leading to a mixer 18 wherein the alkaline solution and steam are mixed with the pulp, a further transport pipe 20 leading to an extraction tower 22 and a transport pipe 24 which leads to an extraction stage washer 26. Recycling is provided for returning effluent from the extraction stage washer 26 by pipe 28 to the chlorination washer 14.

Figure 2:
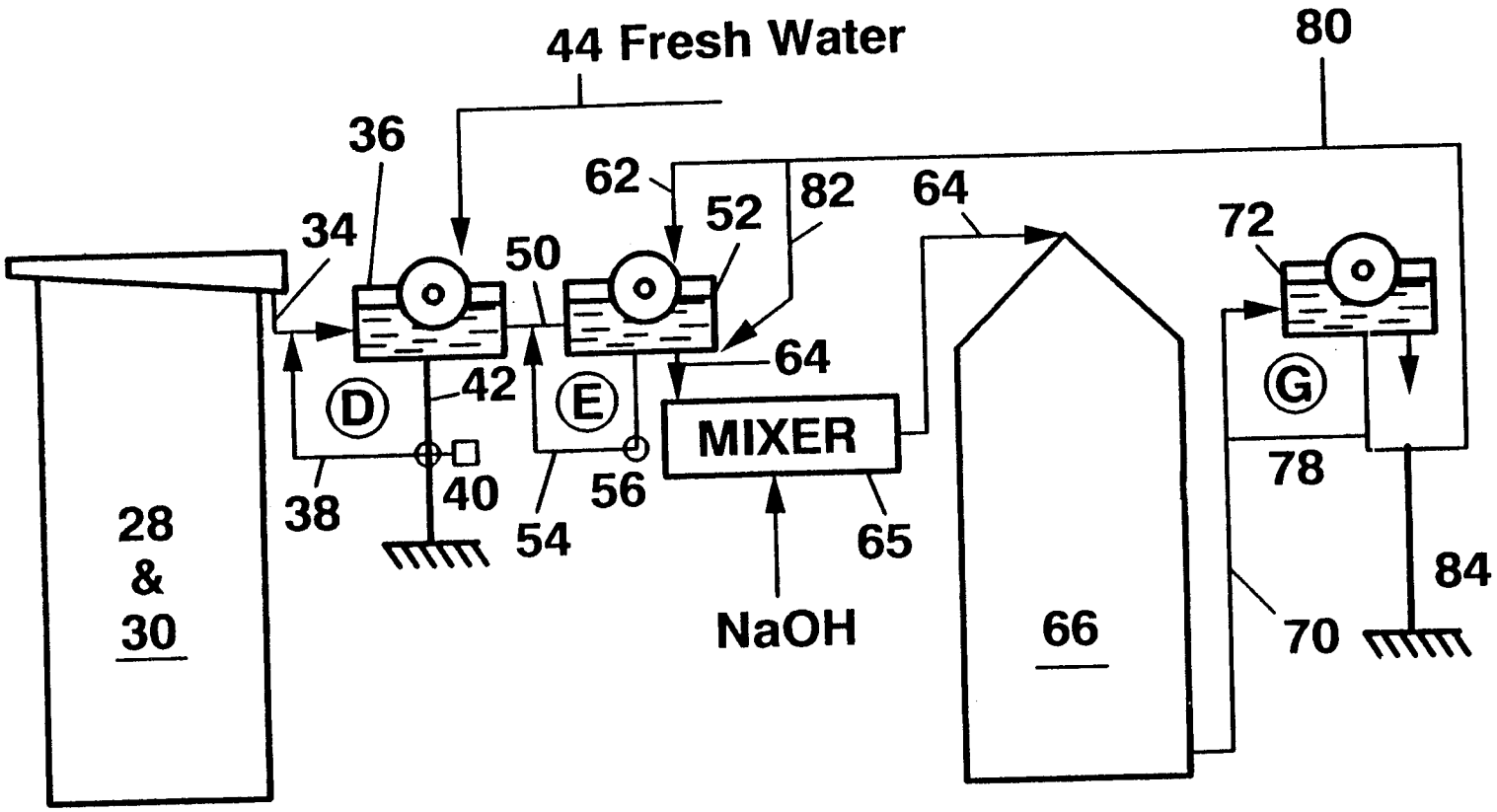
PRIOR ART Figure 2
FIG. 2 is a prior art (Limerick, U.S. Re. Pat. No. 23,868) variation of the conventional recycling system in a bleaching plant in which the effluent from the alkali extraction stage is recycled to a separate washer between the chlorination stage washer and the extraction stage washer.

In a variation of the conventional chlorination bleaching system disclosed in Limerick (RE 23,868) and shown schematically in FIG. 2, the alkaline effluent from the extraction stage washer 72 is recycled via piping 80 to a separate washer 52 positioned in pulp flow relationship between the chlorination stage washer 36 and the extraction tower 66, a portion of the alkaline effluent going through piping 80 to the shower portion 62 of washer 52 and a portion going through piping 82 to dilute the pulp leaving the washer, thereby transporting the thus-generated $NaHCO_3$ and $CO_2$ with the washed pulp to mixer 65, where NaOH is added, and then onto the extraction tower 66. In this procedure, there is no caustic savings since the acid values in the pulp, i.e., $NaHCO_3$ and $CO_2$, react with the added NaOH.

In the present invention illustrated in FIG. 3, as in Limerick (RE 23,868), there is provided an additional washer 30, between chlorination washer 14 and mixer 18. The effluent from the additional washer 30 is recycled to the chlorination washer 14 via line 32 for use as wash water therein. The effluent from extraction washer 26 is recycled via line 28 to the pulp at a point between washers 14 and 30. A source of turbulence at this point is beneficial to ensure proper mixing.

The liquid used for the showers in the additional washer 30 is introduced via line 34 and may be provided from an extraction, effluent or water source (not shown). The additional washing step in washer 30 and the subsequent separation of the effluent from the washed pulp discharged therefrom before the latter is mixed with caustic is critical because it removes from the effluent the $NaHCO_3$ and $CO_2$ formed (along with NaCl) in the reaction of the chlorinated pulp with the extraction stage effluent. If the $NaHCO_3$ and $CO_2$ were permitted to remain with the pulp, the savings in caustic realized in the process of this invention would not be achieved.

In FIG. 4, the principles of the instant invention, as explained with reference to FIG. 3, are shown incorporated into an existing paper facility. Primed reference numerals in FIG. 4 relate structures therein to corresponding structures in FIG. 3.

In adapting the instant invention to the apparatus of FIG. 4, tower 22' is utilized as the extraction tower while existing tower 36 is used as a retention tower in case additional retention capacity might be useful. Pulp and effluent from the extraction stage tower 22' is delivered via line 24' to the extraction stage washer 26' as in the prior art illustration of FIG. 1. A portion of the effluent from the extraction stage washer is bled off via line 28'c and fed into line 16' connecting chlorination washer 14' to mixer 18'. In the embodiment of FIG. 4, the line 28'a initially drains effluent from the extraction stage washer 26' into a seal tank 38 from which it is recycled to extraction stage tower 22' via line 40 and back to the extraction stage washer via line 28'b. Line 28'c converts the apparatus of FIG. 4 to function in accordance with the instant invention by bleeding effluent from line 28'b through controllable valves 42 and 44.

In addition to line 28'c, the improvement of FIG. 4 includes a new line 32'c which recycles effluent from washer 30' to chlorination washer 14' by bleeding effluent from return line 32'b connected to a seal tank 46 to which washer 30' drains via line 32'a.

EXAMPLES

EXAMPLE 1

Example 1 illustrates the sodium hydroxide savings that are achievable by treating washed chlorinated pulp with extraction effluent and separating the thus-obtained effluent prior to mixing the thus-treated pulp with the sodium hydroxide.

A spruce kraft pulp (kappa No. 27.5) was chlorinated, well-washed and pressed to 20% consistency. It was then diluted to 10% consistency with effluent from the first extraction stage. This provided 5 mL of recycled effluent for every 1 g o.d. of pulp. This 5 mL/g, however, could have been added by displacing the liquor associated with the pulp or by just simply diluting to lower consistency. The extraction effluent, at 60° C., remained in contact with the pulp for 5 minutes. The pulp was washed with water and then extracted with aqueous alkali. A second sample was chlorinated, washed well, and pressed to 20% consistency. It was then diluted to 10% consistency with extraction effluent from the first extraction stage. The extraction effluent, at 60° C., remained in contact with the pulp for 5 minutes and then alkali was added to it and the extraction completed. A control sample of washed, chlorinated pulp was extracted without any pretreatment. All 3 pulps were then further bleached using a DED partial sequence.

As Table I shows, when effluent recycle and washing were used according to the invention, final brightness of 89% was easily obtained even though the chemical consumption in the $E_1$ stage was decreased by one-third. The conventional type of recycle wherein the recycled effluent is not washed out of the pulp prior to the extraction stage provided no advantages in terms of CE kappa number or NaOH usage.

TABLE I

| Type of $E_1$ Effluent Recycle | NaOH Charge in the Extraction Stage, % on o.d Pulp | CE kappa No. | ISO Brightness % $D_1$ | ISO Brightness % $D_2$ |
|---|---|---|---|---|
| No recycle | 3.0 | 5.4 | 81.0 | 89.5 |
| | 2.0 | 6.1 | 76.7 | — |
| | 1.0 | 9.0 | 56.5 | 84.6 |
| Conventional | 3.0 | 5.5 | 81.4 | 89.6 |
| Recycle | 2.0 | 5.8 | 76.6 | 87.9 |
| (with no wash) | 1.0 | 8.4 | 60.7 | 85.5 |
| Recycle | 3.0 | 5.1 | 82.2 | 89.9 |
| Followed by | 2.0 | 5.3 | 81.7 | 89.6 |
| Washing | 1.0 | 5.8 | 79.6 | 88.7 |

Unbleached pulp: Black spruce kraft pulp; kappa No., 27.5
C-stage: 5.5% $Cl_2$ on o.d. pulp, 45 min at 25° C.; 3.5% consistency
E-stage: 90 min at 70° C.; 10% consistency
$D_1$-stage: 1% $ClO_2$ and 0.55% NaOH on o.d. pulp; 3 h at 60° C.; 10% consistency
$E_2$-stage: 1% NaOH on o.d. pulp; 1 h at 60° C.; 10% consistency
$D_2$-stage: 0.5% NaOH on o.d. pulp; 3 h at 60° C.; 10% consistency
The extraction effluent used for recycling was produced by extracting the same chlorinated pulp with 3% NaOH on o.d. pulp.

EXAMPLE 2

Table II shows that the alkali savings which were shown to be possible in Example 1 are maintained when the recycling system approaches steady state.

In Run 1, a spruce kraft pulp (kappa No. 27.5) was chlorinated, well washed and extracted (3.0% NaOH on o.d. pulp) without any pretreatment. In Run 2, a second sample of the same pulp was chlorinated, washed well and pressed to 20% consistency. It was then diluted with extraction effluent from the extraction stage of Run 1. The extraction effluent, at 60° C., remained in contact with the pulp for 5 minutes. The pulp was washed with water and then extracted with only 2% of NaOH on o.d. pulp. In Run 3, a third sample of the pulp was chlorinated, washed well and pressed to 20% consistency. It was then diluted with extraction effluent from Run 2. Again the pulp was washed with water and extracted with only 2% NaOH on o.d. pulp. This procedure of using the effluent from the preceding run was repeated. Table II shows that the CE kappa number is maintained even though the NaOH charge was decreased from 3.0 to 2.0% on o.d. pulp in Runs 2, 3 and 4.

In Run 5, a sample of the pulp was chlorinated, well washed and extracted with only 2% NaOH on o.d. pulp. The CE kappa number was higher than the value obtained when using effluent recycle and wash according to the invention.

As can be seen from Table II, a charge of 2% NaOH on o.d. pulp used according to the invention is equal to 3% NaOH used in the conventional manner.

TABLE II

| Type of Process | Run No. | Source of Effluent for Recycle | NaOH Charge in the Extraction Stage, % on o.d. Pulp | CE kappa No. |
|---|---|---|---|---|
| Conventional | 1 | No recy. | 3.0 | 4.3 |
| Recycle/Washing | 2 | Run 1 | 2.0 | 4.3 |
| Recycle/Washing | 3 | Run 2 | 2.0 | 4.1 |
| Recycle/Washing | 4 | Run 3 | 2.0 | 4.0 |
| Conventional | 5 | No Recy. | 2.0 | 5.2 |

Conditions: As listed in footnote to TABLE I.

EXAMPLE 3

This example illustrates that changes in the time and temperature of treatment of chlorinated pulp with recycled extraction effluent do not affect the outcome of the procedure.

A spruce kraft pulp (kappa No. 27.5) was chlorinated, well washed and pressed to 20% consistency. It was then diluted to 10% consistency with effluent from the first extraction stage. A time and temperature combination for this reaction between the chlorinated pulp and the recycled extraction effluent was chosen. The pulp was washed with water and then extracted with 2.0% NaOH on o.d. pulp. The experiment was repeated with different time and temperature combinations for the reaction between the chlorinated pulp and the recycled extraction effluent.

Table III shows that the useful reaction between the chlorinated pulp and the recycled extraction effluent takes place within 30 seconds at temperatures of 25° C. and higher. The significance of this is that the reaction can be done in a pipeline, and no special reaction vessel would be necessary.

TABLE III

| Recycled Extraction Effluent | | CE |
|---|---|---|
| Temperature, °C. | Time of Contact, min. | kappa No. |
| 25 | 0.5 | 3.9 |

TABLE III-continued

| Recycled Extraction Effluent | | CE |
|---|---|---|
| Temperature, °C. | Time of Contact, min. | kappa No. |
| 60 | 0.5 | 4.0 |
| 60 | 1.0 | 4.0 |
| 60 | 5.0 | 4.1 |
| 60 | 10.0 | 3.9 |

C- and E-stage conditions: As in footnote to TABLE I.

EXAMPLE 4

The addition of a small amount of chlorine dioxide to the pulp in the chlorination stage is a common practice for minimizing the damage done to cellulose during chlorination.

Table IV shows that the CE kappa number of conventionally treated pulp is not much affected if 10% $ClO_2$ substitution is used. Moreover, by treating the chlorinated pulp according to the invention a reduction in E-stage NaoH to 2.0% or less can be achieved regardless of whether $ClO_2$ is used or not.

TABLE IV

| Type of Process | $ClO_2$ Substitution in C-Stage % | NaOH Charge in the Extraction stage, % on o.d. pulp | CE kappa No. |
|---|---|---|---|
| Conventional | 0 | 3.0 | 4.3 |
| Recycle/Washing | 0 | 2.0 | 4.2 |
| Recycle/Washing | 0 | 1.5 | 4.2 |
| Recycle/Washing | 0 | 1.0 | 4.1 |
| Conventional | 10 | 3.0 | 4.1 |
| Recycle/Washing | 10 | 2.0 | 4.0 |
| Recycle/Washing | 10 | 1.5 | 4.3 |
| Recycle/Washing | 10 | 1.0 | 4.4 |

Unbleached Pulp: Black spruce krafi pulp: kappa No. 27.5
C-Stage: 5.5% $Cl_2$ on o.d. pulp: 45 min at 25° C.: 3.5% consistency
$C_D$-Stage: 5.0% $Cl_2$ and 0.2% $ClO_2$ on o.d. pulp: 45 min at 25° C.: 3.5% consistency
E-Stage: 90 min at 70° C.: 10% consistency.
The extraction effluent used for recycling was produced by extracting the same chlorinated pulp with 3% NaOH on o.d. pulp.

EXAMPLE 5

The following is a description of the process of this invention as practiced commercially, as reported in more detail in TAPPI Proceedings, 1988 Pulping Conference, New Orleans, La. (Tappi Press, pp. 747–752).

Pulp Modifications

FIG. 4 shows part of a mill bleach plant. Tower 36 is the original extraction tower and Tower 22 is the original H-stage tower which prior to the trial was used only for buffer stage.

For the first trial, the extraction stage was moved from Tower 36 to Tower 22' which gave a long retention time in Tower 36 for the Papricycle step. This long retention time was not necessary because the reactions occurring in the Papricycle step are very fast (Table III), but it was easiest in this application to keep the tower in use. The time was shortened to some extent by operating Tower 36 at about the 50% level. The large volume of filtrate from Washer 26' was pumped through a new line to the steam mixer ahead of Tower 36 and the consistency in the tower then fell to about 5%. Washer 30' filtrate now was used for shower water on washer 14.

With this configuration, an 8-hour Papricycle trial was run during July, 1987. The first two stages of the bleach plant were shut down to change over and within 2 hours the bleach plant was running again with the Papricycle step. There were no serious problems in switching over or running the new process. The result was caustic savings in the order of 10 to 15 kg/ADMT. At the same time, however, chlorine dioxide usage in a bleaching Tower (not shown) went up marginally. This increase in chlorine dioxide usage had been anticipated because in making the conversion, a second wash step between the E- and D-stages was eliminated. The increase, however, was not observed in a later, more lengthy trial, which shows that Papricycle can have a substantial effect in reducing carry-over into the D-stage.

A longer trial was scheduled for August 1987 and a number of modifications were undertaken, viz., a flow meter 48 and control valve 44 were installed on the new filtrate line 28'c to Tower 36; the shower piping on Washer 26' was modified so that Seal Tank 50 ($D_2$-stage) filtrate went to the top two headers and hot water went to the bottom two, lastly a pH probe was installed in Washer 30' vat.

After two days on the extended trial it was decided that the new process was to be permanent. After 11 months of operating experience the only problem that was encountered was that the new filtrate line plugged with fiber. A check valve eliminated this problem. Startups and shutdowns were found to be no different with Papricycle than they were with the unmodified bleach plant.

Chemical Usage

Chemical usage data for 6 weeks prior to the start of Papricycle are compared to 12 months after using Papricycle is Table V:

TABLE V

| Bleaching Chemical Usage | Change |
|---|---|
| Total Act. $Cl_2$ in C-stage | +2% |
| $E_1$-stage NaOH | −24% |
| $D_1$-stage NaOH | −82% |
| $D_1$-stage $ClO_2$ | −1% |

The total active chlorine in the chlorination stage and the chlorine dioxide usage in the $D_1$-stage both remained almost constant while the extraction stage caustic was reduced by 24% due to Papricycle.

The percentage decrease in caustic usage was less than the one third saving found possible in the laboratory. However, because of the higher caustic charges used in the mill, the actual amount of caustic saved was larger than in any of the laboratory work. These observations are probably explained by the difference between the quality of washing in the laboratory and in the mill.

The % savings have now been recognized as higher because part of the extraction stage caustic charge is made up of "blowdown caustic" from a scrubber which contains sodium hypochlorite rather than sodium hydroxide. Also the % savings have been increased through better control using an automatic pH loop and through better washing caused by replacement of the showers on the chlorination washer. Now the $E_1$-stage caustic usage has been decreased to 65% of the original consumption.

The observed decrease in the $D_1$-stage caustic application was due to the rearrangement of the showers on the extraction stage washer just ahead of the $D_1$-stage. The $D_2$-stage filtrate was moved from the bottom shower bars to the top and hot water was moved from the top to the bottom. However, this saving represents only a small amount of caustic (1 kg/ADMT).

Operating Changes

Extracted brightness is used as a control factor at the mill and initially a two point drop in this extracted brightness was observed (Table VI). It was found that the extracted brightness was affected by the Papricycle step pH, with a pH around 6 resulting in a lower extracted brightness. The pH target was raised and the extracted brightnesses returned to around 36. The $E_1$-stage average pH was maintained at 10.7 throughout this period of evaluation.

Recycling large amounts of hot filtrate has the potential to decrease steam usage. This was borne out by the results at the mill where there was an increase of 11° C. in the Tower 22' caustic extraction stage temperature after the Papricycle step was installed. This temperature rise corresponds to a steam saving of 0.43 GJ/ton pulp, and at a cost of $4.15/GJ this represents a potential energy saving of $1.78/ADMT. (The above dollar amounts and those below are in Canadian dollars.)

TABLE VI

| Bleach Plant Operating Data | Before Papricycle | After Papricycle |
|---|---|---|
| Average K. No. | 22.6 | 22.6 |
| Extracted Brightness, % | 36.2 | 34.3 |
| $D_1$ Stage Brightness, % | 83.6 | 82.7 |
| $E_1$ Stage pH | 10.7 | 10.7 |
| Papricycle Stage pH | | 6.9 |
| Tower 36 Temp. °C. | 77 | 77 |
| Tower 22' Temp. °C. | 60 | 71 |

Effluent Changes

The bleach plant effluent was monitored over the period June through October. The color and $BOD_5$ concentrations increased after the use of Papricycle whereas the pH and sodium ion concentration decreased (Table VII). The color and $BOD_5$ concentrations increased because of reduced fresh water usage and greater use of filtrates. The pH and sodium ion concentrations decreased because most of the residual alkali normally going to sewer was consumed and caustic dosage was decreased. Other work has shown that if the BOD and color are measured on a pulp basis, they do not change.

TABLE VII

| Effluent Properties* | Before Papricycle | After Papricycle |
|---|---|---|
| Color, ppm. | 6240 | 7800 |
| pH | 11.1 | 9.3 |
| $BOD_5$, ppm. | 140 | 270 |
| $Na^+$, ppm. | 1360 | 1260 |

*Monitored over the same time period as TABLE VI

Pulp Property Changes

The finished pulp properties were reviewed by comparing the first six months of 1987 with the last 3 months of 1987 (Table VIII). There was no significant difference in any of the properties evaluated.

TABLE VIII

| Average Finished Pulp Properties | Before Jan-June 1987 | After Oct-Dec 1987 |
|---|---|---|
| Brightness, % TAPPI | 91.1 | 91.0 |
| Dirt, ppm. | 1.9 | 2.0 |
| Burst @ 400 CSF | 5.7 | 5.6 |
| Tear @ 400 CSF | 8.7 | 9.1 |
| Tensile @ 400 CSF | 85.8 | 87.9 |
| Viscosity, cps. | 14.7 | 14.3 |

Cost Savings

The chemical cost savings attributed to Papricycle at the plant in Canada, described above are $525,000/t for a 325 t/d line while the total cost of installing the new process was $23,000. This represents a saving of $4–$5/t of pulp produced with a payback time of 15 days.

The large increase in the Tower 22' temperature during the trial shows that there is also a potential steam saving by using Papricycle. If the steam costs $5/GJ, then every 10° C. rise in temperature caused by recycle will save $1.5/t of pulp.

It will be apparent from the foregoing that a displacement bleaching system can be used to perform the process of this invention.

The concept of using the extraction effluent as described is not affected by chemical addition, e.g., oxygen, peroxide or hypochlorite, to the extraction stage. Chemical addition to the extraction stage will not alter the principle of decreasing the sodium hydroxide charge by washing after recycling and before the extraction stage.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a pulp bleaching process wherein a chlorinated pulp is sequentially washed in a chlorination stage first washing step, the washed pulp is separated from the effluent, the separated washed pulp is mixed with an alkaline extracting solution and subjected to an alkaline extraction stage, the extraction stage pulp is washed in an alkaline extraction stage second washing step to produce a washed, extracted pulp is then separated from the thus-produced alkaline effluent, the improvement which comprises the steps of:

(i) washing the pulp in the chlorination stage first washing step in first and second washers and in the extraction stage second washing step in a third washer, mixing the separated washed chlorinated pulp, at a point between the first and second washers of the chlorination stage first washing step with the alkaline effluent from the extraction stage second washing step and washing the separated washed chlorinated pulp with the alkaline effluent in the second washer to produce an acidic values-containing effluent and a pulp pretreated with alkali; and (ii) separating the thus-obtained acidic values-containing effluent from the thus-obtained pretreated pulp prior to mixing the latter with the alkaline extraction solution, thereby decreasing the amount of alkali required in the alkaline extraction stage.

2. The process of claim 1, wherein the effluent from the additional wash step in the second washer is recycled to and used as wash water in the chlorination washing step.

3. The process of claim 1, wherein all of the alkaline effluent is mixed with the washed chlorinated pulp.

4. The process of claim 1, wherein the alkali used in the extraction stage is sodium hydroxide.

5. The process of claim 1, wherein in Step (i), turbulence is provided at the point of mixing to ensure thorough mixing of the alkaline effluent with the washed chlorination stage pulp.

6. The process according to claim 1, wherein the pulp is kraft pulp.

7. The process of claim 1, wherein the separated effluent from the washing step in the second washer is recycled to and used as shower water in the chlorination washing step; wherein all of the extraction effluent is used to treat the washed chlorinated pulp; and wherein the alkali used in the extraction stage is sodium hydroxide.

8. The process of claim 7, wherein in Step (i), turbulence is provided at the point of mixing of the alkaline effluent to ensure thorough mixing with the washed chlorination stage pulp; and wherein the pulp is kraft pulp.

* * * * *

UNITED STATES PATENT AND TRADEMARK OFFICE

CERTIFICATE OF CORRECTION

PATENT NO. : 5,126,009

DATED : June 30, 1992

INVENTOR(S) : Richard M. Berry et al

It is certified that error appears in the above-indentified patent and that said Letters Patent is hereby corrected as shown below:

Column 3, line 61, Move "(5)" to flush right of column.

Column 8, line 22, Reads "NaoH" should read --NaOH--.

Column 12, line 2, claim 1, After "pulp" insert --and an alkaline effluent, and the washed, extracted pulp --.

line 14, claim 1, after "pulp" insert --in admixture --.

Signed and Sealed this

Fourteenth Day of September, 1993

Bruce Lehman

*Attest:*

BRUCE LEHMAN

*Attesting Officer*

*Commissioner of Patents and Trademarks*